US010053283B1

(12) United States Patent
Stravitz

(10) Patent No.: US 10,053,283 B1
(45) Date of Patent: Aug. 21, 2018

(54) WASTE CONTAINER WITH BAG HANDLING ASSEMBLY

(71) Applicant: David M Stravitz, New York, NY (US)

(72) Inventor: David M Stravitz, New York, NY (US)

( * ) Notice: Subject to any disclaimer, the term of this patent is extended or adjusted under 35 U.S.C. 154(b) by 0 days.

(21) Appl. No.: 15/923,532

(22) Filed: Mar. 16, 2018

Related U.S. Application Data

(60) Continuation-in-part of application No. 15/668,414, filed on Aug. 3, 2017, now Pat. No. 9,994,392, which is a continuation of application No. 15/413,163, filed on Jan. 23, 2017, now Pat. No. 9,745,127, which is a continuation-in-part of application No. 14/935,835, (Continued)

(51) Int. Cl.

| | |
|---|---|
| ***B65F 1/06*** | (2006.01) |
| ***B65F 7/00*** | (2006.01) |
| ***B65F 1/14*** | (2006.01) |
| ***B65F 1/16*** | (2006.01) |

(Continued)

(52) U.S. Cl.

CPC ..... *B65F 1/06* (2013.01); *B65B 67/1233* (2013.01); *B65F 1/068* (2013.01); *B65F 1/1415* (2013.01); *B65F 1/163* (2013.01); *B65F 7/00* (2013.01); *B65F 1/10* (2013.01); *B65F 2001/1676* (2013.01); *B65F 2210/129* (2013.01); *B65F 2220/128* (2013.01); *B65F 2240/132* (2013.01)

(58) Field of Classification Search

CPC ..... B09B 3/0025; B09B 3/0075; B65B 9/15; B65B 67/1277; B65B 67/1233; B65B 67/12; B65B 67/1205; B65B 67/1211; B65B 67/1216; B65B 67/1222; B65B 67/1227; B65F 1/062; B65F 1/1607; B65F 1/16; B65F 1/06; B65F 1/14; B65F 1/04; B65F 7/00; B65F 1/068; B65F 1/1415; B65F 1/163; B65F 1/10; B65F 2001/1676; B65F 2220/128; B65F 2220/129; B65F 2240/132; A01M 1/2055; B65D 2251/1016

USPC ..... 248/99–101; 220/833, 834, 908, 908.1, 220/495, 8, 495.06, 320, 315, 324, 254.1, 220/254.4, 254.6, 254.5, 259.1, 259.2, 220/817, 818, 819–826

See application file for complete search history.

(56) References Cited

U.S. PATENT DOCUMENTS 1,719,185 A 7/1929 Lowy
1,978,314 A * 10/1934 Lancaster ..... F16J 13/18 220/259.2

(Continued)

*Primary Examiner* — Andrew Perreault
(74) *Attorney, Agent, or Firm* — Brian Roffe

(57) ABSTRACT

Container including a base and an outer wall defining an interior space receivable of a bag. A bag handling assembly is coupled to the wall and includes a retainer connected to the wall, a bag support pivotally coupled to the retainer by cooperating hinge components on the retainer and bag support, and a closure component pivotally coupled to the bag support by cooperating hinge components on the bag support and closure component, independent of the pivotal coupling of the bag support to the retainer. The container includes two separate and independent pivotal attachment mechanisms, one of which serves to fix a bag between the closure component and bag support and the other of which serves to enable better access to the interior of the container for bag insertion and removal.

20 Claims, 12 Drawing Sheets

Related U.S. Application Data filed on Nov. 9, 2015, now Pat. No. 9,573,757, which is a continuation-in-part of application No. 14/709,878, filed on May 12, 2015, now Pat. No. 9,555,962, which is a continuation-in-part of application No. 14/537,044, filed on Nov. 10, 2014, now Pat. No. 9,181,028, which is a division of application No. 14/109,270, filed on Dec. 17, 2013, now Pat. No. 8,910,821, said application No. 14/935,835 is a continuation-in-part of application No. 14/537,044, filed on Nov. 10, 2014, now Pat. No. 9,181,028, which is a division of application No. 14/109,270, filed on Dec. 17, 2013, now Pat. No. 8,910,821.

(60) Provisional application No. 61/881,386, filed on Sep. 23, 2013.

(51) Int. Cl.
*B65B 67/12* (2006.01)
*B65F 1/10* (2006.01)

(56) References Cited

U.S. PATENT DOCUMENTS 2,434,238 A 1/1948 Wolfson
2,793,373 A 5/1957 Ewing
3,214,065 A 10/1965 Thornton
4,427,110 A 1/1984 Shaw, Jr.
4,765,579 A 8/1988 Robbins, III
4,902,482 A 2/1990 Faust
4,955,566 A 9/1990 Blocih
5,174,462 A 12/1992 Hames
D334,975 S 4/1993 Bunce et al.
5,385,259 A 1/1995 Bernstein et al.
5,520,303 A 5/1996 Bernstein et al.
5,556,063 A 9/1996 Boyd
5,836,553 A 11/1998 Bergaila
5,988,520 A 11/1999 Bitner
6,206,221 B1 3/2001 Bando et al.
D457,283 S 5/2002 Wayt
6,540,103 B2 4/2003 Silvers
6,612,099 B2 9/2003 Stravitz
D485,404 S 1/2004 Del Prato
6,679,462 B1 1/2004 Valdez
6,719,194 B2 4/2004 Richards
6,804,930 B2 10/2004 Stravitz
6,817,164 B2 11/2004 Mauffette et al.
6,837,394 B2 1/2005 Nnamani
6,851,251 B2 2/2005 Stravitz
6,904,867 B2 6/2005 Zamjahn
6,974,029 B2 12/2005 Morand et al.
7,086,569 B2 8/2006 Stravitz
7,114,314 B2 10/2006 Stravitz
7,146,785 B2 12/2006 Stravitz
D537,598 S 2/2007 Moore
7,225,943 B2 6/2007 Yang et al.
RE39,726 E 7/2007 Lin
7,316,100 B2 1/2008 Stravitz et al.
7,406,814 B2 8/2008 Morand
7,434,377 B2 10/2008 Stravitz et al.
7,503,152 B2 3/2009 Stravitz et al.
7,503,159 B2 3/2009 Stravitz et al.
7,516,865 B1 4/2009 Pierre
7,543,716 B2 6/2009 Lin
D596,364 S 7/2009 Morand
7,617,659 B2 11/2009 Stravitz et al.
7,696,711 B2 4/2010 Pollack et al.
7,708,188 B2 5/2010 Stravitz et al.
7,712,285 B2 5/2010 Stravitz et al.
D619,905 S 7/2010 Dunn et al.
7,878,359 B1 2/2011 Ko
7,931,150 B2 4/2011 Morand
D639,002 S 5/2011 Dunn et al.
D639,003 S 5/2011 Dunn et al.
D639,004 S 5/2011 Dunn et al.
7,963,414 B1 6/2011 Stravitz
D652,189 S 1/2012 Morand
D654,738 S 2/2012 Morand
8,127,519 B2 3/2012 Stravitz
D657,107 S 4/2012 Fitzpatrick et al.
8,215,089 B2 7/2012 Stravitz
8,235,237 B1 8/2012 Stravitz
8,266,871 B1 9/2012 Stravitz
8,393,489 B1 3/2013 Stravitz
8,567,157 B2 10/2013 Dunn et al.
8,635,838 B2 1/2014 Dunn et al.
8,647,587 B2 2/2014 Dunn et al.
8,657,139 B1 2/2014 Bodine
8,690,017 B2 4/2014 Dunn et al.
8,739,501 B2 6/2014 Dunn et al.
8,752,724 B2 6/2014 Babikian et al.
8,833,592 B2 9/2014 Dunn et al.
8,834,023 B1 9/2014 Laera
8,844,751 B2 9/2014 Sakaguchi et al.
8,899,420 B2 12/2014 Morand
8,910,821 B1 12/2014 Stravitz
8,959,880 B2 2/2015 Morand
8,973,774 B1 3/2015 Stravitz
D728,184 S 4/2015 Hoggatt et al.
9,085,404 B2 7/2015 Dunn et al.
D766,534 S 9/2016 Stravitz
D777,394 S 1/2017 Stravitz
D797,393 S 9/2017 Stravitz
2002/0051739 A1 5/2002 Wang
2003/0085227 A1 5/2003 Azzarello
2005/0056649 A1 3/2005 Simonson et al.
2008/0000912 A1* 1/2008 Lin ..... B65F 1/06 220/495.08
2008/0134644 A1 6/2008 Knuth et al.
2008/0264948 A1 10/2008 Kovacevich et al.
2009/0046955 A1 2/2009 Schember et al.
2010/0005762 A1 1/2010 Stravitz
2010/0140423 A1 6/2010 Davies et al.
2011/0099958 A1 5/2011 Dunn et al.
2012/0211494 A1 8/2012 Morand
2013/0181000 A1 7/2013 Miksovsky et al.
2013/0252534 A1 9/2013 Smith
2014/0027452 A1 1/2014 Pan
2014/0042168 A1 2/2014 Dunn et al.

* cited by examiner

WASTE CONTAINER WITH BAG HANDLING ASSEMBLY

CROSS-REFERENCE TO RELATED APPLICATIONS

This application is a continuation-in-part (CIP) of U.S. patent application Ser. No. 15/668,414 filed Aug. 3, 2017, now U.S. Pat. No. 9,994,392, which is a continuation of U.S. patent application Ser. No. 15/413,163 filed Jan. 23, 2017, now U.S. Pat. No. 9,745,127, which is:

a CIP of U.S. patent application Ser. No. 14/709,878 filed May 12, 2015, now U.S. Pat. No. 9,555,962, which is a CIP of U.S. patent application Ser. No. 14/537,044 filed Nov. 10, 2014, now U.S. Pat. No. 9,181,208, which is a divisional of U.S. patent application Ser. No. 14/109,270 filed Dec. 17, 2013, now U.S. Pat. No. 8,910,821, which claims priority under 35 U.S.C. § 119 of U.S. provisional patent application Ser. No. 61/881,386 filed Sep. 23, 2013; and a CIP of U.S. patent application Ser. No. 14/935,835 filed Nov. 9, 2015, now U.S. Pat. No. 9,573,757, which is:

- a CIP of U.S. patent application Ser. No. 14/537,044 filed Nov. 10, 2014, now U.S. Pat. No. 9,181,208, which is a divisional of U.S. patent application Ser. No. 14/109,270 filed Dec. 17, 2013, now U.S. Pat. No. 8,910,821, which claims priority under 35 U.S.C. § 119 of U.S. provisional patent application Ser. No. 61/881,386 filed Sep. 23, 2013; and
- a CIP of U.S. patent application Ser. No. 14/709,878 filed May 12, 2015, now U.S. Pat. No. 9,555,962, which is a CIP of U.S. patent application Ser. No. 14/537,044 filed Nov. 10, 2014, now U.S. Pat. No. 9,181,208, which is a divisional of U.S. patent application Ser. No. 14/109,270 filed Dec. 17, 2013, now U.S. Pat. No. 8,910,821, which claims priority under 35 U.S.C. § 119 of U.S. provisional patent application Ser. No. 61/881,386 filed Sep. 23, 2013, all of which are incorporated by reference herein.

FIELD OF THE INVENTION

The present invention relates generally to waste disposal devices that may be used for any type of waste, including but not limited to, cat litter, medical waste from hospitals, doctors' offices, home health care personnel and facilities, nursing homes, biohazard laboratories, diapers, general household waste, disposables and the like, and include structure that securely retains or traps a bag so that the bag does not fall into the waste receptacle when waste is inserted.

BACKGROUND OF THE INVENTION

Waste disposal devices are common in hospitals, doctors' offices, kitchens and other household locations and other locations where waste is generated and must be disposed of in a sanitary manner. Waste disposal devices are also often used to dispose of household waste, cat litter and other pet waste. If the waste emits odors, the waste disposal device should also contain odors emanating from the waste.

Some waste disposal devices include a dispenser that dispenses tubing, and therefore include an internal ring-shaped flange on which a tubular core or cartridge rests and houses a continuous length of flexible, substantially non-resilient plastic tubing. A knot is tied at one end and the continuous tubing is pulled down to the bottom of the pail to form a bag for inserting one diaper after another until the bag is full. When full, you cut the top of the bag with a built in blade and then tie a knot in the open area for subsequent removal. This procedure is once again repeated—tie the knot—fill the bag—remove the bag, etc. When the canister is depleted of bag lengths, one replaces the canister. Canisters are costly and require changing regularly.

Another disposal device utilizes a single use bag sealed at one end and is welded to a foldable plastic header at the open end. The header when opened flat rests securely in the pail to accept diapers as they fill up. Once full, the plastic header folds to seal the upper open area and at the same time forms a handle for convenient removal. These polypropylene living hinge headers are wasteful, costly to produce and require welding or bonding them to a one time use bag.

Numerous waste disposal devices exist including those disclosed in U.S. Pat. Nos. 6,612,099, 6,804,930, 6,851,251, 7,086,569, 7,114,314, 7,146,785, 7,316,100, 7,434,377, 7,503,152, 7,503,159, 7,617,659, 7,708,188, 7,712,285, 7,963,414, 8,127,519, 8,215,089, 8,235,237, 8,266,871, 8,973,774 and all of which are incorporated by reference herein. Additionally, innovative waste disposal devices are disclosed in U.S. patent application Ser. No. 12/172,715 filed Jul. 14, 2008, now abandoned, Ser. No. 13/172,976 filed Jun. 30, 2011, now abandoned, and Ser. No. 13/270,697 filed Oct. 11, 2011, now abandoned, all of which are incorporated by reference herein.

Some of these waste disposal devices include a base defining a waste-receiving compartment and a lid pivotally connected to the base. When the lid is opened, a bag becomes visible and waste is inserted into an opening of the bag. The bag often passes through a membrane that requires force to insert the waste, and also serves to close the bag above the waste providing a barrier to waste and odor outflow. In some waste disposal devices, the bag is actually part of an accordion-folded length of flexible tubing that is housed in a cartridge.

Further, some of these waste disposal devices include a step or foot pedal assembly to complement or replace the manual opening and closing of the lid. The foot pedal assembly includes a depressible foot pedal and a spring, and is arranged to cause both opening of the lid when the foot pedal is depressed and closure of the lid when the pressing force is removed. The spring is moved against its bias upon depression of the foot pedal and returns to its original state when the pressing force is removed to thereby cause closure of the lid and rotation of the twisting mechanism.

SUMMARY OF THE INVENTION

A container in accordance with the invention includes at least one wall defining an interior space receivable of a bag and a bag handling assembly coupled to the wall(s). The bag handling assembly includes a retainer coupled to the wall(s), a bag support pivotally coupled to the retainer, and a closure component pivotally coupled to the bag support independent of the pivotal coupling of the bag support to the retainer. A first attachment structure pivotally attaches the bag support to the retainer, e.g., a hinge component on the retainer and a cooperating hinge component on the bag support on a first side of an opening defined by the retainer. A second attachment structure pivotally attaches the closure component to the bag support, e.g., an additional hinge component on the bag support and a cooperating hinge component on the closure component on a second side of the opening defined by the retainer. As such, the first and second attachment structures are on different sides of the opening defined by the retainer. Advantages of this construction are to streamline the use of the container by preventing interference when both attachment structures are in their opened component state.

To fix the bag between the closure component and the bag support, the bag support includes an inner wall for supporting an open end of the bag, as well as an outer wall spaced from the inner wall, and a rim portion between the inner and outer walls, with a channel being defined above the rim portion between the inner and outer walls. The closure component defines a channel on an underside dimensioned relative to the inner wall such that when the closure component is pivoted against the bag support, the inner wall is received in the channel.

To secure the closure component to the bag support, the closure component includes a tab and the bag support includes a flexible retainer that cooperates with the tab to enable temporary securing of the closure component to the bag support via engagement of the tab with the retainer.

In one embodiment, the bag support includes a membrane that optionally includes intersecting channels and intersecting slits at an angle from the channels, the channels being dimensioned to allow the bag to be received therein.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
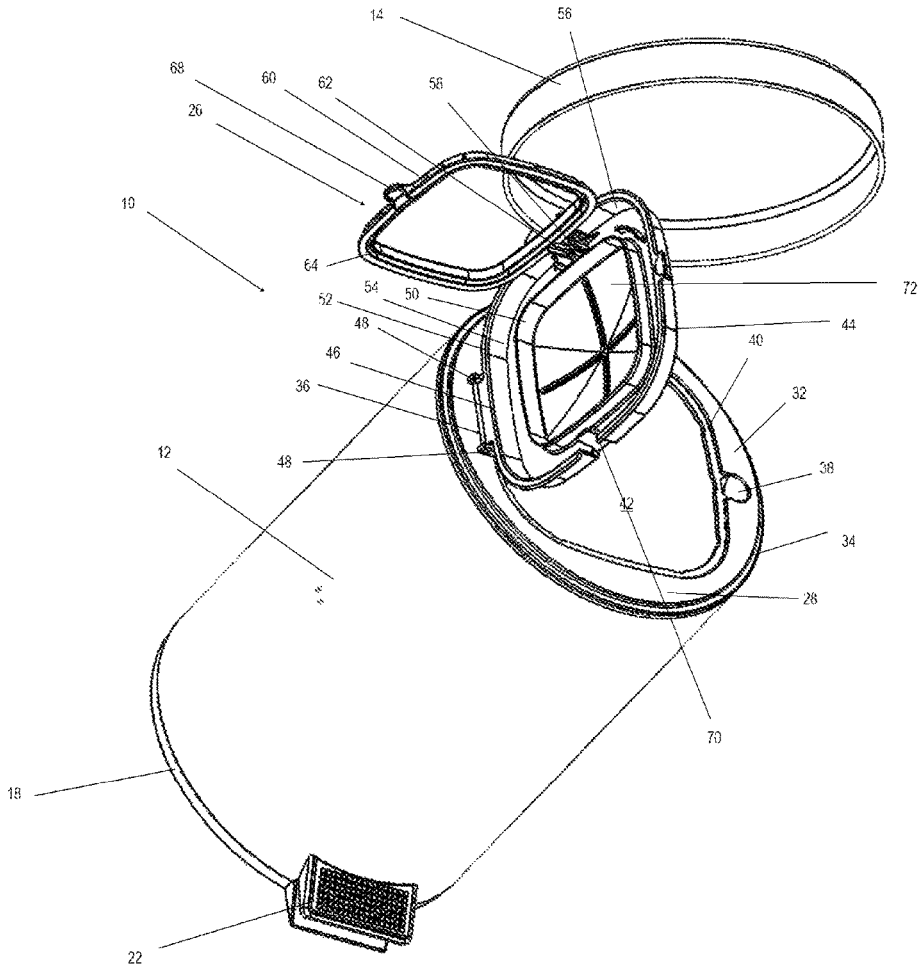
FIG. 1 is a perspective view of a container with a bag handling assembly in accordance with the invention.
Figure 2:
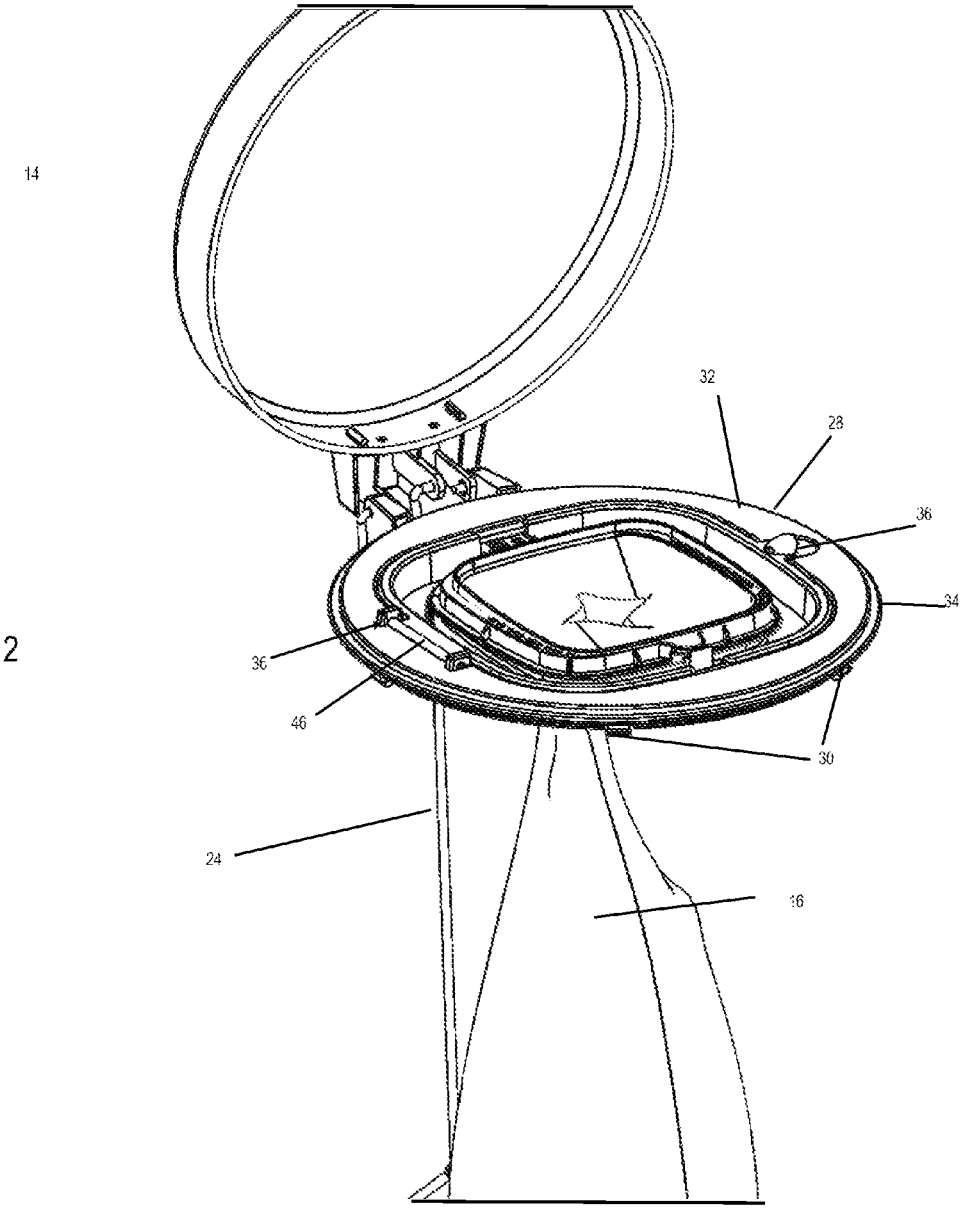
FIG. 2 is a perspective view of the container shown in FIG. 1 with an outer wall removed and including a bag.

Referring to the accompanying drawings wherein like reference numerals refer to the same or similar elements, FIG. 1 shows a container 10 in accordance with the invention which is preferably used to dispose of waste, but which may be used for any purpose. Container 10 includes an outer wall 12 that is substantially cylindrical, and a lid 14 that has a first, open position in which access to a bag 16 retained in the container 10 is possible and a second, closed position in which access to the bag 16, and more generally, to the interior of the container 10, is prevented. Outer wall 12 represents at least one wall that defines an interior space or compartment in the container 10 that is receivable of a bag into which waste is to be placed. It may consist of a single wall or comprise multiple walls.

Figure 5:
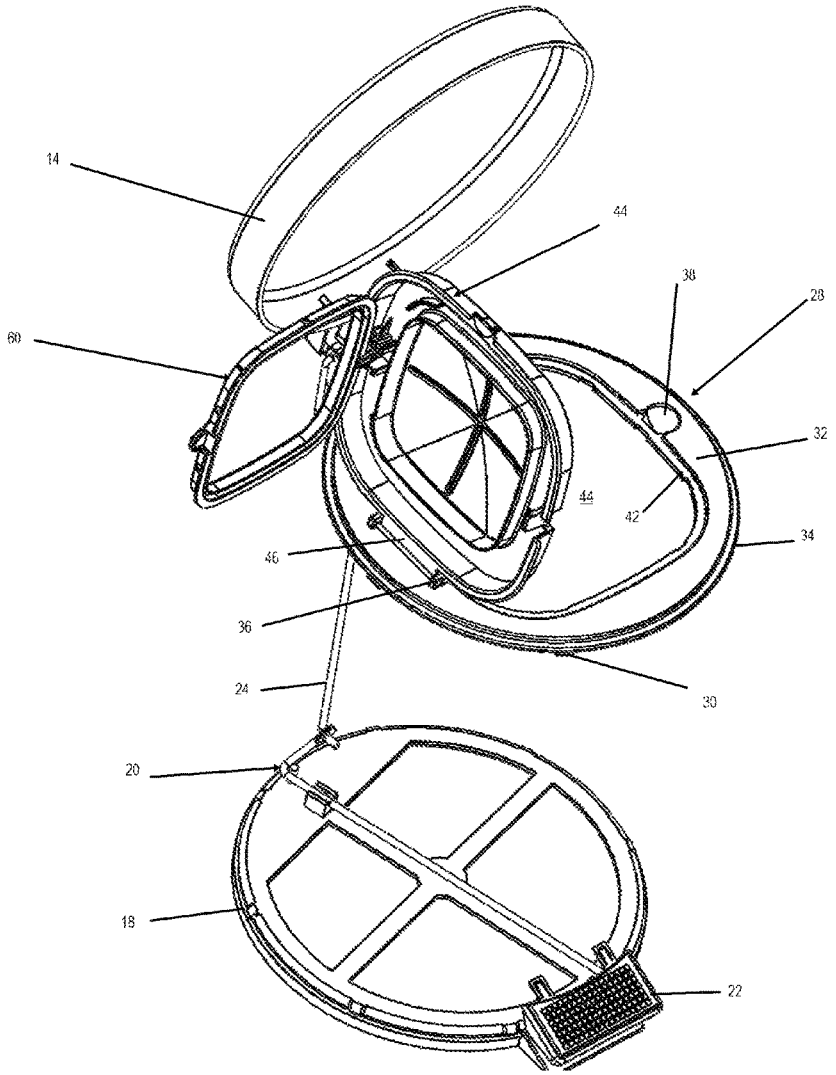
FIG. 5 is a perspective view of the container shown in FIG. 1 with the outer wall removed and showing part of a lid control mechanism.

Container 10 also includes a base 18, see FIG. 5, on which the outer wall 12 is supported, and a lid control mechanism 20 that controls opening and closing of the lid 14, i.e., movement of the lid 14 between its open and closed positions. Base 18 may alternatively be integrated into the outer wall 12. Control mechanism 20 may include a foot pedal 22 and actuating rods 24 that cooperate to convert downward movement of the foot pedal 22 into opening movement of the lid 14, see FIG. 5. The foot pedal 22 is biased to return to an upper position to enable repeated downward movement. One skilled in the art would understand how to make and use the control mechanism 20, and numerous and different types of control mechanisms 20 are known to those skilled in the art and may be used in the invention. Often, the control mechanism 20 is concealed in the outer wall 12 and/or the base 18 of the container 10.

Indeed, the general properties of the container 10 are not material to the invention and the invention may be used in any type, shape and size of container without limitation to the type and shape disclosed and illustrated herein.

Container 10 includes a bag handling assembly 26 that has three main parts. The first part is a retainer 28 that extends inward from the outer wall 12 and when formed separate therefrom, is coupled to the outer wall 12. Retainer 28 may be an integral part of the container 10 or a separate component that is temporarily or permanently attached to the outer wall 12 or another part of the container 10 to provide a secure base for the remaining parts of the bag handling assembly 26. As shown, the retainer 28 is attached to the outer wall 12 by pegs 30, see FIGS. 2-5, that insert into corresponding recesses or apertures in the outer wall 12 (not shown). Pegs 30 exemplify structure that may be used to connect the retainer 28 to the outer wall 12, and do not in any way limit the invention. Instead of pegs 30, it is also possible to provide the retainer 28 with one or more flexible tabs with apertures therein which slide over cooperating projections on the inner surface of the outer wall 12 to thereby fix the retainer 28 to the outer wall 12 (see FIGS. 10-12, described below). The retainer 28 may also be molded together with the outer wall 12.

Any structure which connects the retainer 28 to the outer wall 12 is considered coupling means for coupling the retainer 28 to the outer wall 12. One skilled in the art of containers would understand that such coupling means encompass a wide variety of structure known to those skilled in the plastics manufacturing field.

Bag handling assembly 26 may have a unitary structure which is formed as a unit and then attached to the outer wall 12 of the container 10.

Retainer 28 generally has the same shape as the cross-sectional shape of the outer wall 12 but this is not a limitation on the retainer 28. The term "coupled to" or variants thereof when used to describe a functional relationship between two components means that one component may be attached to the other component directly or is attached indirectly to the other component via one or more other components.

Figure 7:
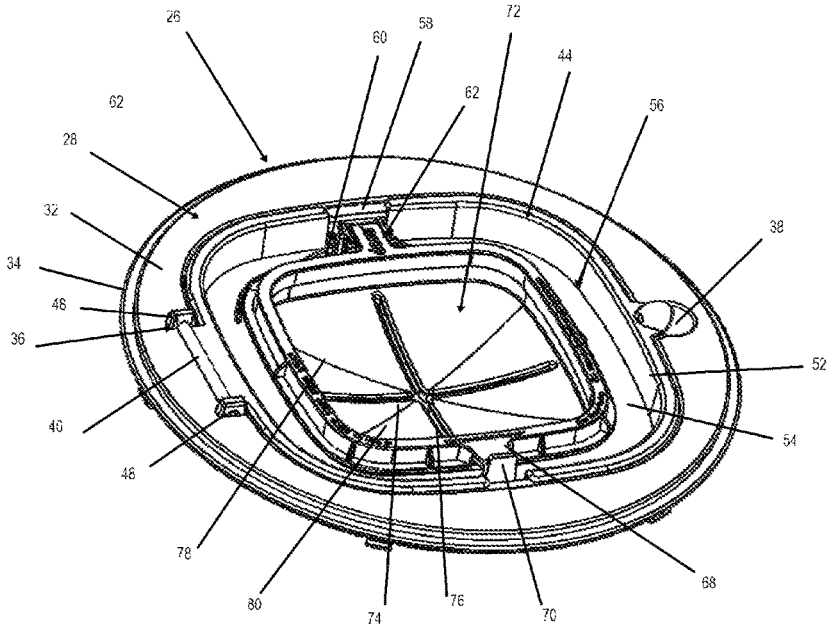
FIG. 7 is a perspective view of an upper portion of the container shown in FIG. 1 showing the bag handling assembly in accordance with the invention.
Figure 8:
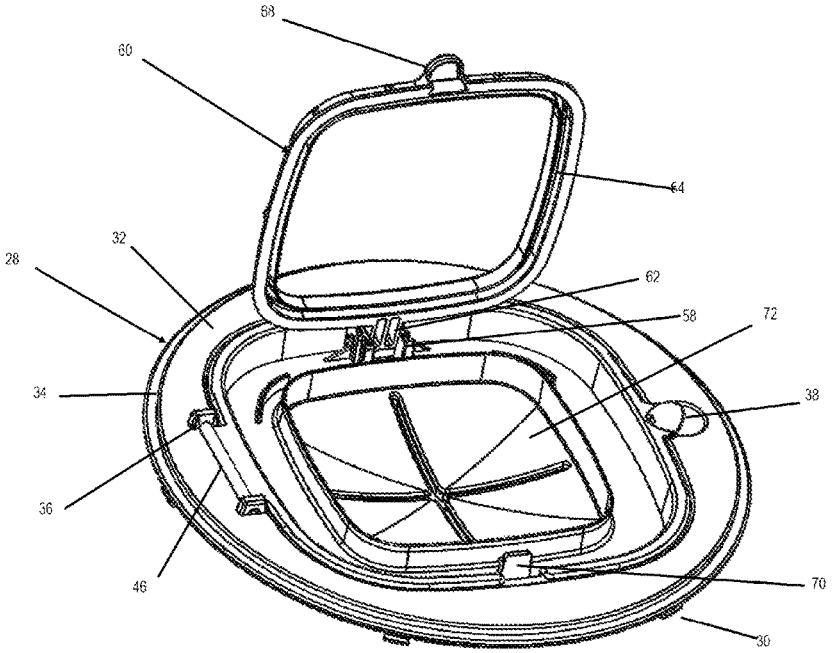
FIG. 8 is a perspective view of the upper portion of the container shown in FIG. 1 showing the bag handling assembly in accordance with the invention in the state which enables securing of the bag and release of the bag from its secured state.
Figure 9:
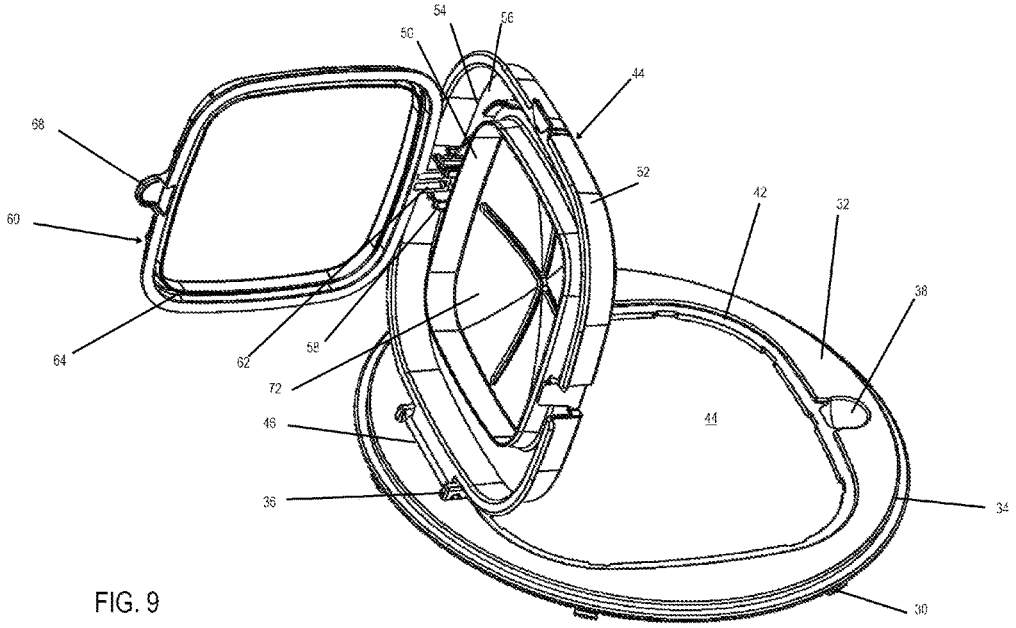
FIG. 9 is a perspective view of the upper portion of the container shown in FIG. 1 showing the bag handling assembly in accordance with the invention in the state which enables insert of the bag into and removal of the bag from the container.

Retainer 28, seen more clearly in FIGS. 7-9, has a rim portion 32 and an indented lip 34 around the rim portion 32. Rim portion 32 is substantially planar but is not required to have this form. A hinge component 36 is arranged on, coupled to or integrated into the rim portion 32, and opposite the hinge component 36, there is a recess 38. Retainer 28 also includes a peripheral seat 40 around an internal aperture or opening 42. Hinge component 36 is therefore situated between the seat 40 and the outer peripheral edge of the retainer 28.

The second part of the bag handling assembly 26 is a bag support 44 which includes a hinge component 46 that mates with hinge component 36 to enable the bag support 44 to pivot relative to the retainer 28. Bag support 44 has a generally annular form defining an opening, annular being used herein to mean defining an opening without limiting the shape of the bag support 44. The structure of the hinge components 36, 46 may be any known type of structure which includes a part on each of two components with these parts interacting to allow for pivotal movement, whether a hinge or referred to by another commercial name. Such hinge components 36, 46 are well-known to those skilled in the field of hinges and more generally pivotal attachment structure.

In one exemplifying embodiment, the hinge component 36 comprises a pair of projections 48 that project upward from the rim portion 32 of the retainer 28 and the hinge component 46 comprises an elongate axle that is rotatably retained at each end by the projections 48. Such structure, and all equivalents and comparable structure, will be referred to as attachment means for pivotally attaching the bag support 44 to the retainer 28.

Bag support 44 also includes an inner wall 50 over which the open end of the bag 16 is placed, an outer wall 52 spaced from the inner wall 50 by a lower wall 54 to thereby define a channel 56 above the lower wall 54 and between the inner and outer walls 50, 52. Both the inner and outer walls 50, 52 are elevated in a common direction from the lower wall 54. A hinge component 58 is arranged on or integrated into the lower wall 54.

The third part of the bag handling assembly 26 is a closure component 60 which includes a hinge component 62 that mates with hinge component 58 to enable the closure component 60 to pivot relative to the bag support 44. Hinge component 62 projects from an annular part of the closure component 60 by an extension piece, annular being used herein to mean defining an opening without limiting the shape of the closure component 60. The structure of the hinge components 58, 62 may be any known type of structure which includes a part on each of two components with these parts interacting to allow for pivotal movement, whether a hinge or referred to by another name. Such hinge components 58, 62 are well-known to those skilled in the field of hinges and more generally pivotal attachment structure.

In one exemplifying embodiment, the hinge component 58 comprises a projecting structure that projects upward from the lower wall 54 of the bag support 44 and the hinge component 62 comprises an elongate axle that is rotatably retained by the projecting structure. Such structure, and all equivalents and comparable structure, will be referred to as attachment means for pivotally attaching the closure component 60 to the bag support 44.

The combination of the hinge components 58, 62 (the second attachment means) are situated radially inward of the combination of the hinge components 36, 46 (the first attachment means) because the closure component 60 is smaller in size than the bag support 44, and the bag support 44 is smaller in size than the retainer 28.

When the closure component 60 is in a down position against the bag support 44, the bag 16 is pressed between the closure component 60 and the bag support 44. More specifically, the closure component 60 defines a channel 64 on an underside, see, e.g., FIGS. 1 and 3-6, that is receivable of the inner wall 50 of the bag support 44 such that upon pivoting of the closure component 60 into engagement with the inner wall 50, the bag 16 when present is clamped between the closure component 60 and the inner wall 50. Channel 64 is generally defined by two spaced apart walls and bottom wall to form the downwardly oriented channel 64. Closure component 60 thus has a generally square shape like the shape of the inner wall 50, although their shapes may vary.

Bag support 44 therefore serves two important functions, first to provide a pivotal attachment to the retainer 28 to enable access to an interior of the container 10 for removal of the bag 16 when it has been used to hold for example waste, and second to provide the inner wall 50 to allow for selective clamping of an open end of the bag 16 by the closure component 60 against this inner wall 50. This clamping is a contact pressing with the bag 16 being pressed by the closure component 60 against the inner wall 16 to thereby trap odor arising from material in the bag 16 inside of the bag 16. When the bag is not present, there may be contact between the closure component 60 and the inner wall 50 or only a slight allowance of less than the thickness of a bag expected to be used in the container 10.

Figure 4:
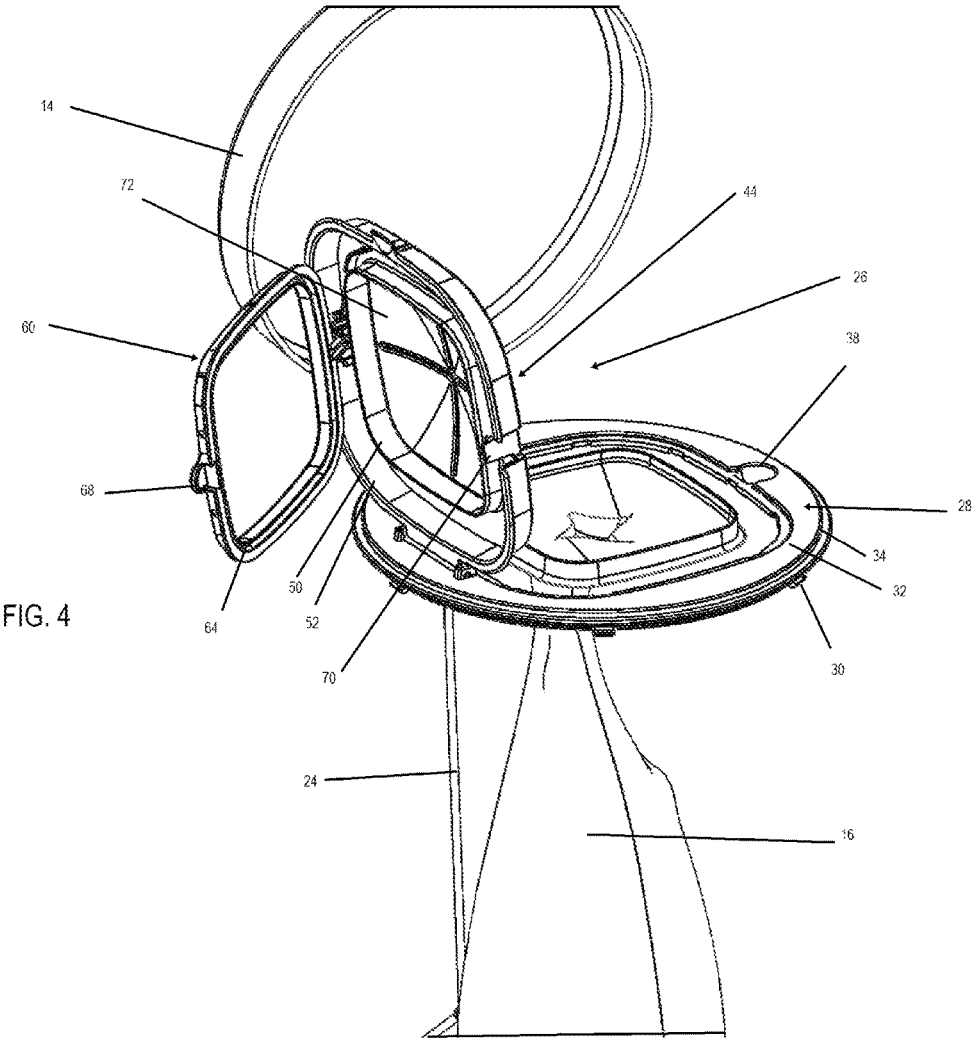
FIG. 4 is a perspective view of the container shown in FIG. 1 with the outer wall removed and including a bag, and showing the state which enables insert of the bag into and removal of the bag from the container.
Figure 6:
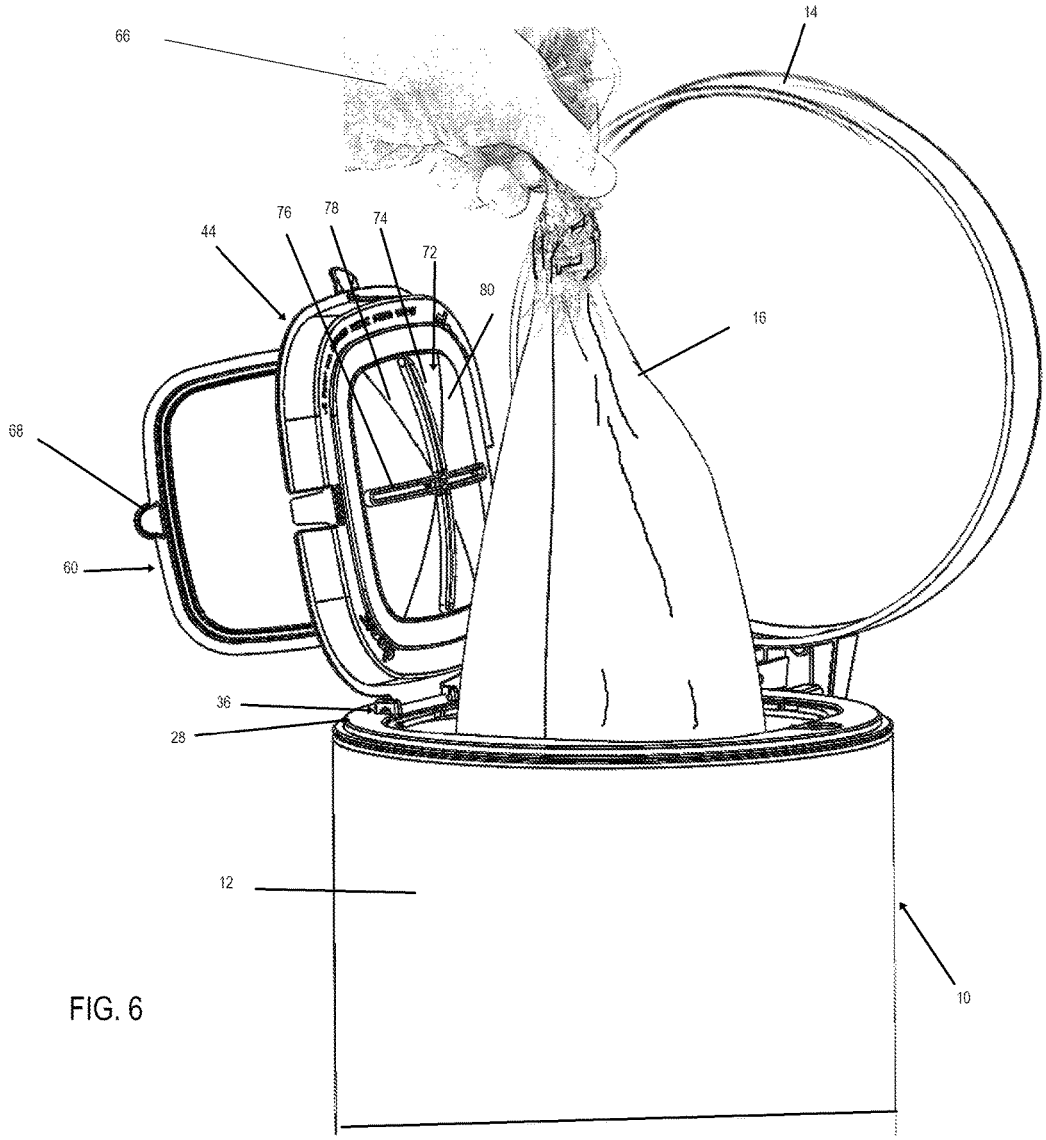
FIG. 6 is a perspective view of the container shown in FIG. 1 showing removal of the bag from the container.

As to the former function, the bag support 44 can be pivoted upward by the cooperating hinge structure 36, 46 to enable access to the bag 16, see FIGS. 1 and 4, and notably FIG. 6 wherein the removal of a bag 16 containing waste while the bag support 44 is pivoted upward relative to the retainer 28 is shown. It is not required that the closure component 60 be pivoted upward away from the bag support 44 when the bag support 44 is pivoted upward relative to the retainer 28 to remove a bag from the container 10.

Figure 3:
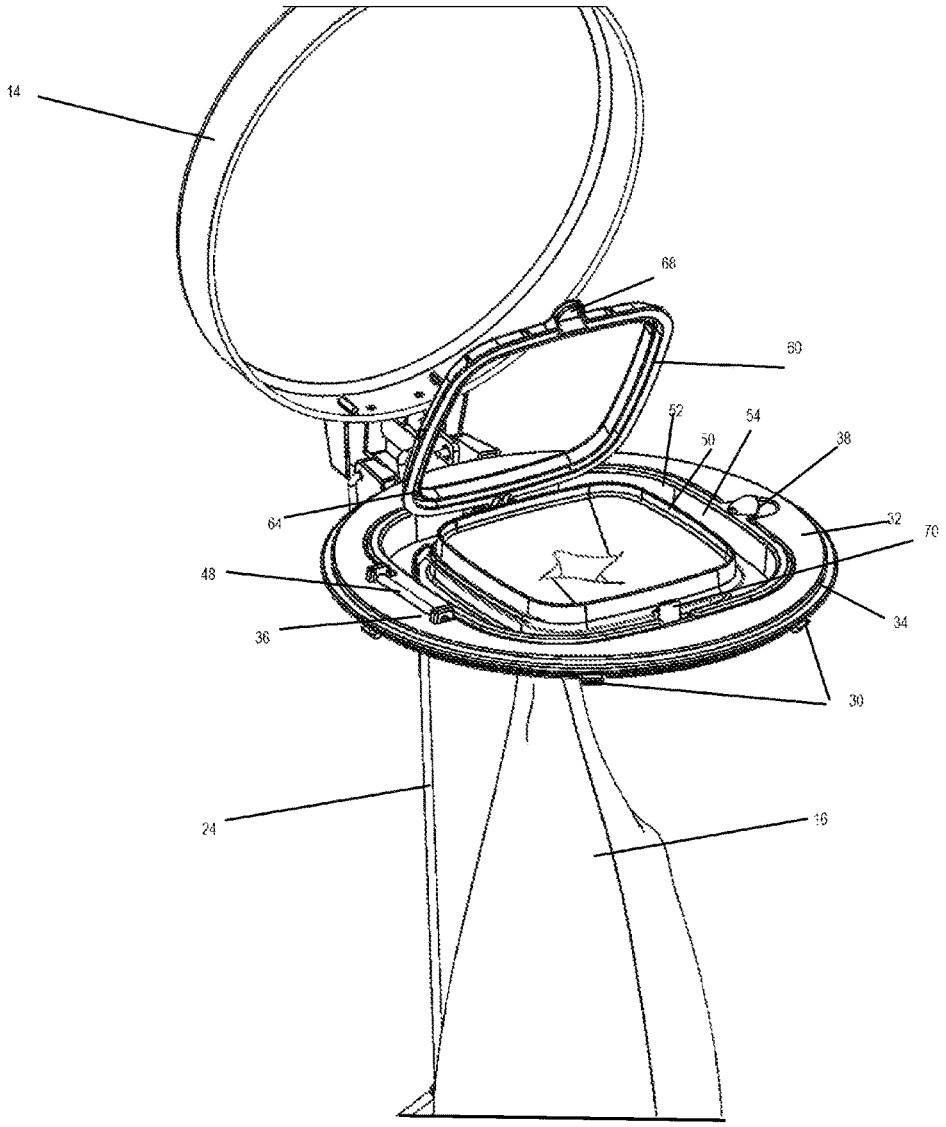
FIG. 3 is a perspective view of the container shown in FIG. 1 with the outer wall removed and including a bag, and showing the state which enables securing of the bag and release of the bag from its secured state.

Bag removal is facilitated by, once the bag 16 is full or it otherwise desired to change the bag 16, pivoting the closure component 60 upward relative to the bag support 44 to release the clamping force of the closure component 60 against the bag support 44, see FIG. 3. Then, the end of the bag 16 is grasped, possibly tied, and then inserted through the bag support 44 into the interior of the container 10. Then, the bag support 44 is pivoted upward relative to the retainer 28 by the user inserting their finger into the recess 38 in the retainer 28 and lifting the bag support 44 upward to thereby increase the size of the opening at the top of the container 10, see FIG. 4. Finally, the bag 16 is grasped by the user's hand 66 and pulled out of the interior of the container 10, see FIG. 6.

A new, single use bag is then procured, placed into the interior of the container 10. This placement may be either before the bag support 44 is pivoted downward to rest on the retainer 28 or after. In the former situation, the bag support 44 is pivoted downward and the user has to extend their hand through the bag support 44 to reach the upper end of the bag 16 and pull the bag 16 through the bag support 44 to drape the upper end over the inner wall 50. In the latter situation, the user pushes the bag 16 through the bag support 44 and then drapes the upper end of the bag 16 over the inner wall 50. In both situations, the upper end of the bag 16 has its open end draped over the inner wall 50 and then the closure component 60 is pivoted against the inner wall 50 to secure this new bag 16 in a position ready for use.

Closure component 60 includes an optional tab 68 opposite the hinge component 62, and an optional flexible retainer 70 is arranged on the lower wall 54 of the bag support 44. The tab 68 can be pressed under a lip of the retainer 70 to thereby secure the closure component 60 to the bag support 44 and prevent upward pivotal movement of the closure component 60 relative to the bag support 44. To release the tab 68 from the retainer 70, the retainer 70 is flexed outward allowing the tab 68 to be lifted upward. Additional details of the cooperation of a tab and retainer are disclosed in the applicant's earlier U.S. patent application Ser. No. 15/413,163 filed Jan. 23, 2017, Ser. No. 14/935,835 filed Nov. 9, 2015, Ser. No. 14/709,878 filed May 12, 2015, Ser. No. 14/537,044 filed Nov. 10, 2014, Ser. No. 14/109,270 filed Dec. 17, 2013, 61/881,386 filed Sep. 23, 2013, all of which are incorporated by reference herein.

Instead of the cooperating tab 68 and retainer 70, other structure may be provided on and/or integrated into the bag support 44 and the closure component 60 to enable the closure component 60 to be temporarily secured to the bag support 44 during use of the container 10. Generally, such structure will be referred to as securing means for securing the closure component 60 to the bag support 44.

Bag support 44 includes an optional membrane 72 that may be integrated into the bag support 44 by attaching it to the inner wall 50 and/or lower wall 54. Membrane 72 may be a separate component from the bag support 44 and attached thereto. As shown, the membrane 72 includes two intersecting channels 74, 76 and two intersecting slits 78, 80 at an angle of about 45 degrees from the channels 74, 76. Other formations of channels and/or slits may be provided for the membrane 72 as they are not critical to the invention. With the disclosed formation, it becomes possible to push the bag 16 into one of the channels 74, 76 to be held therein while preventing release of odor from any waste in the bag 16. The bag 16 could be pushed by structure disclosed in the patents and patent applications incorporated by reference above. Additional advantages of a membrane are detailed in the patent applications incorporated by reference above. Indeed, all of the features of an insert assembly disclosed in these patents and patent applications are envisioned and contemplated by the inventor to be incorporated into the bag handling assembly 26 of the invention to the extent possible, and should be considered part of the invention.

Instead of the bag removal and insertion procedure described above involving the two pivotal movements to release the bag 16 from its clamping and then to increase the size of the opening, it is possible to construct the container 10 with an access door in the outer wall 12, and then access the bag 16 with waste by opening the access door. An empty bag 16 may also be inserted through the access door and then its upper end passed upward through the membrane 72, then its upper end draped over the inner wall 50 and then the closure component 60 closed to clamp the upper end of the bag 16 between the inner wall 50 and the closure component 60.

From the above description, several features are apparent.

First, the unitary bag handling assembly 26 includes two separate and independent pivotal attachment means or pivotal attachment structure, one constructed and positioned to attach the bag support 44 to the retainer 28 and enable relative movement therebetween and another to attach the closure component 60 to the bag support 44 and enable relative movement therebetween. The bag support 44 thus includes two separate hinge components 46, 58 on the bag support 44. This dual, independent hinged structure provides significant benefits for a waste container used with, for example, a single-use bag because the bag support 44 includes one set of hinge components 36, 46 to secure the bag 16 during use, and another set of hinge components 58, 62, to enable easy access to the bag 16 when it is sought to remove the bag 16 from the interior of the container 10 and replace it with an empty bag 16.

Second, as shown, in a preferred embodiment, the attachment means are not arranged on the same side of the bag handling assembly 26. Rather, referring to FIG. 1, the hinge components 36, 46 are arranged on the left side of the bag handling assembly 26, i.e., on the left side of the opening 42 defined by the retainer 28, whereas the hinge components 58, 62 are arranged at the upper side of the bag handling assembly 26 and above the opening 42 defined by the retainer 28. The hinge components 36, 46 could also be arranged on the right side of the bag handling assembly 26 opposite the hinge components 36, 46. By positioning the hinge components on different sides of the bag handling assembly 26, there is less interference during the pivotal opening of the bag support 44 relative to the retainer 28 while the closure component 60 has already been opened relative to the bag support 44. Thus, the structure of the container 10 does not obstruct any of these pivotal movements when opening both the closure component 60 and the bag support 44 to access a full bag of waste.

In one embodiment of the invention, the retainer 28 is fixed to the outer wall 12 of the container 10 and the remaining parts of the bag handling assembly 26, i.e., the bag support 44 and the closure component 60 are considered an insert or unitary insert to the container 10 or insert assembly as used in the applicant's other patents and patent applications mentioned herein. This insert is attached to the retainer 28 by pressing the hinge component 46 into engagement with the hinge component 36. For this embodiment, the retainer 28 may even be integrated into the container 10 while including a suitable hinge component 36. A snap-in type of hinge is known to those skilled in the pivotal attachment field, or those with knowledge of such devices.

The container 10 may be used without the lid 14. In addition, it is possible to attach the bag handling assembly 26 to other receptacles, e.g., a wall-mounted receptacle. The bag handling assembly 26 is therefore used to control access of waste into a bag when retained by the bag handling assembly 26 and also facilitate removal of the bag when full of waste.

The bag handling assembly 26 in its entirety may be formed as an insert or insert assembly wherein the retainer 28 is constructed to be attachable to a wall of a pail or other support structure that defines a receptacle for receiving waste. The retainer 28 is then fixed to the support structure and the bag handling assembly 26 is thereby operable in the manner disclosed above.

Container 10 can be used with a waste treatment component disclosed in the applicant's patents and patent application mentioned. Such a waste treatment component would be constructed to preferably contact (when a bag is not present) and thus press against the membrane 72 to thereby press any waste thereon (when a bag is present) through the opening of the bag 16 retained by the membrane 72 and into the bag below the membrane 72. The waste treatment component releases deodorizing materials to eliminate odor from the inserted waste.

Figure 10:
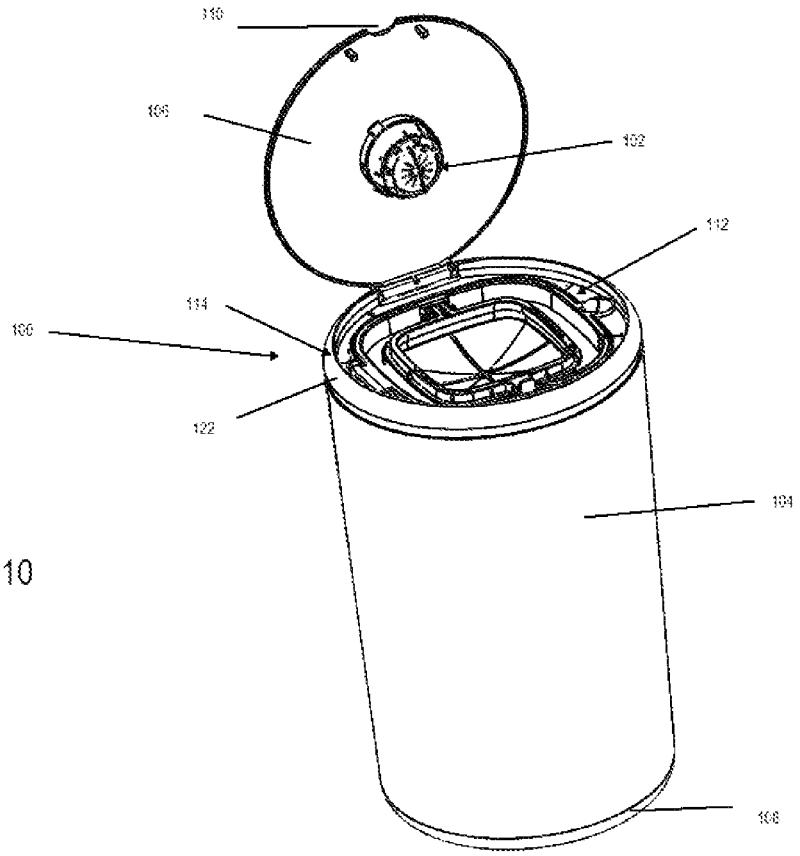
FIG. 10 is a perspective view of a second embodiment of a container with a bag handling assembly in accordance with the invention.
Figure 11:
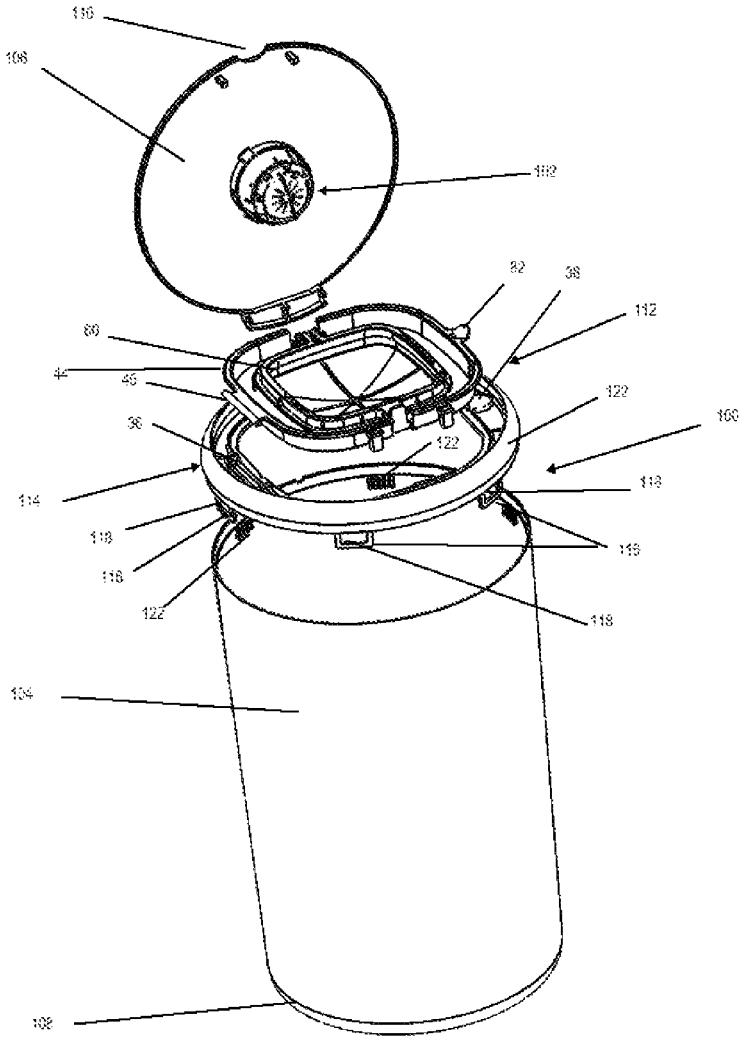
FIG. 11 is an exploded view of the container shown in FIG. 10.
Figure 12:
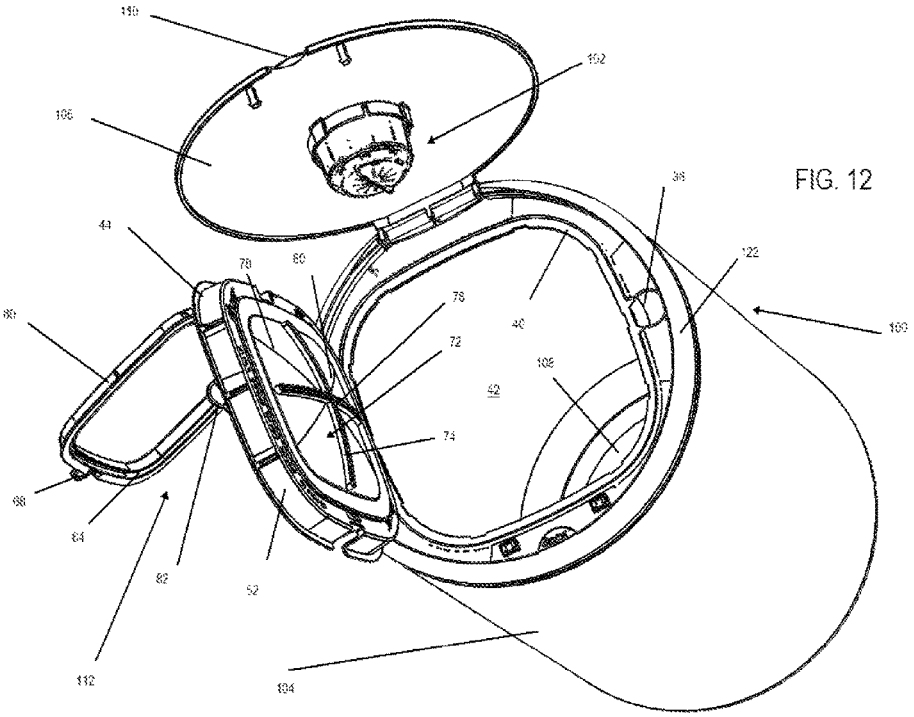
FIG. 12 is a perspective view of the container shown in FIG. 10 showing the bag handling assembly in accordance with the invention in the state which enables insert of the bag into and removal of the bag from the container.

FIGS. 10-12 show such a container 100 with a waste treatment component 102. Container 100 includes an outer wall 104 that is substantially cylindrical, and a lid 106 that has a first, open position in which access to a bag (not shown) retained in the container 100 is possible and a second, closed position in which access to the bag, and more generally, to the interior of the container 100, is prevented. Outer wall 104 represents at least one wall that defines an interior space or compartment in the container 100 that is receivable of a bag into which waste is to be placed. It may consist of a single wall or comprises multiple walls.

Container 100 also includes a base 108 on which the outer wall 104 is supported. The lid 106 includes an indentation 110 to enable it to be manually opened. Such an indentation on the lid may be used for lid 14 in container 10 (FIGS. 1-9), and the control mechanism 20 in container 10 (FIGS. 1-9) may be used in container 100. The waste treatment component 102 is mounted on the underside of the lid 106 and dispenses, for example, deodorizing material.

General properties of the container 100 are not material to the invention and the invention may be used in any type, shape and size of container without limitation to the type and shape disclosed and illustrated herein.

Container 100 includes a bag handling assembly 112 similar to bag handling assembly 26, and only differences will be mentioned. Bag handling assembly 112 includes the bag support 44 and closure component 60, and retainer 114 which is similar to but slightly different than retainer 28 (and the features of retainer 114 that are the same as those in retainer 28 are designated with the same reference numbers). One difference is the manner in which the retainer 114 is attached to the outer wall 104. The retainer 114 includes flexible tabs 116 with apertures 118 which cooperate with an equal number of cooperating projections 120 on the inner surface of the outer wall 104, see FIG. 11. The projections 120 are dimensioned to fit in the apertures 118. The retainer 114, and thus the bag handling assembly 112 in its entirety, is therefore not permanently integrated into the container 100 but rather may be formed as a separate assembly and then assembled with the outer wall 104 to form the container 100.

To assemble the container 100 in one embodiment, the retainer 114, either once the bag support 44 and closure component 60 are attached thereto or before such attachment, is rotated to align the tabs 116 with the projections 120. The retainer 114 is then pressed downward to cause the tabs 116 to flex inward and over the projections 120. This pressing continues until the tabs 116 pass over the projections 120, at which time, the tabs 116 flex outward and the projections 120 are then situated in the apertures 118 of the tabs 116. A secure attachment of the retainer 114, and thus the bag handling assembly 112 in its entirety, to the outer wall 104 of the container 100 is thus provided.

Retainer 114 generally has the same shape as the cross-sectional shape of the outer wall 104 but this is not a limitation on the retainer 114. Retainer 114 has a rim portion 122 from which the tabs 116 project downward. The hinge component 36 is situated between the seat 40 and the rim portion 122.

Container 100 may be constructed to provide an additional function for the waste treatment component 102, and specifically, that it operatively pushes waste on the bag lying on the membrane 72 through the membrane 72. To provide this effect, the container 100 is constructed such that the waste treatment component 102 has a height that is the same as or just slightly smaller than the distance between the membrane 72 and the lower surface of the lid 104. As such, when the lid 104 is closed, the waste treatment component 102 will push waste on the bag that lies on the membrane 72 through the membrane 72 and into the bag portion below the membrane.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. Indeed, combinations of features of the bag handling assemblies 26, 112 disclosed herein may be used together to create a new bag handling assembly. Moreover, features of container 10 may be used in conjunction with container 100 and vice versa. Also, features of the insert described in FIGS. 64 and 65A-65C of the '414 application may be used in bag handling assemblies 26, 112, and features of the other inserts disclosed in the '414 application may also be used in the containers 10, 100 and in particular in the bag handling assemblies 28, 112. All such combinations and permutations of features of the bag handling assemblies disclosed herein are considered part of the invention.

The invention claimed is:

1. A container, comprising:

at least one wall defining an interior space receivable of a bag; and a bag handling assembly coupled to said at least one wall, said bag handling assembly comprising:

a retainer extending inward from said at least one wall at an upper end region of said at least one wall, said retainer defining an opening;

a bag support pivotally coupled to said retainer, said bag support defining an opening; and a closure component pivotally coupled to said bag support independent of the pivotal coupling of said bag support to said retainer, said closure component defining an opening, said bag support and said closure component including cooperating clamping structure that clamps the bag between said bag support and said closure component while said closure component is pivoted against said bag support, whereby the bag is clamped by said cooperating clamping structure and, while said closure component is pivoted against said bag support and said bag support is pivoted against said retainer, passes through the openings defined by said bag support and said retainer and enables access to an interior of the bag through the openings defined by said closure component, said bag support and said retainer.

2. The container of claim 1, further comprising first attachment means for pivotally attaching said bag support to said retainer.

3. The container of claim 2, wherein said first attachment means comprise a hinge component on said retainer and a cooperating hinge component on said bag support on a first side of the opening defined by said retainer.

4. The container of claim 3, further comprising second attachment means for pivotally attaching said closure component to said bag support.

5. The container of claim 4, wherein said second attachment means comprise an additional hinge component on said bag support and a cooperating hinge component on said closure component on a second side of the opening defined by said retainer such that said first and second attachment means are on different sides of the opening defined by said retainer.

6. The container of claim 3, wherein said retainer further comprises a rim portion and a recess on said rim portion opposite said hinge component, said bag support including a tab aligning with said recess.

7. The container of claim 1, wherein said retainer is integral with said at least one wall.

8. The container of claim 1, wherein said retainer includes a rim portion and a hinge component arranged on or integrated into said rim portion.

9. The container of claim 1, wherein said bag support includes an inner wall for supporting an open end of the bag, an outer wall spaced radially outward from said inner wall, and a lower wall between said inner and outer walls, a channel being defined above said lower wall between said inner and outer walls, said inner wall being closer to an aperture of said bag support through which the bag passes than said outer wall.

10. The container of claim 9, wherein said closure component defines a channel on an underside dimensioned relative to said inner wall such that when said closure component is pivoted against said bag support, said inner wall is received in said channel and contacts said closure component, whereby said inner wall and said channel constitute said cooperating clamping structure.

11. The container of claim 1, wherein said closure component includes a tab and said bag support includes a flexible retainer that cooperates with said tab to enable temporary securing of said closure component to said bag support via engagement of said tab with said retainer.

12. The container of claim 1, wherein said bag support includes a membrane.

13. The container of claim 12, wherein said membrane includes intersecting channels and intersecting slits at an angle from said channels, said channels being dimensioned to allow the bag to be received therein.

14. The container of claim 1, further comprising:

first attachment means for pivotally attaching said bag support to said retainer; and second attachment means for pivotally attaching said closure component to said bag support.

15. The container of claim 14, wherein said first attachment means are situated on a first side of the opening defined by said retainer and said second attachment means are situated on a second side of the opening defined by said retainer such that said first and second attachment means are on different sides of the opening defined by said retainer.

16. The container of claim 15, wherein said first attachment means comprise a hinge component on said retainer and a cooperating hinge component on said bag support and said second attachment means comprise an additional hinge component on said bag support and a cooperating hinge component on said closure component.

17. The container of claim 14, wherein said first attachment means are radially outward of said second attachment means such that said first and second attachment means are at different distances from a center of said bag handling assembly.

18. The container of claim 1, further comprising:

a hinge component on said retainer;

a first hinge component on said bag support that cooperates with said hinge component on said retainer to enable pivotal movement of said bag support relative to said retainer;

a second hinge component on said bag support; and a hinge component on said closure component that cooperates with said second hinge component on said bag support to enable pivotal movement of said closure component relative to said bag support independent of pivotal movement of said bag support relative to said retainer.

19. The container of claim 1, further comprising:

a lid that moves between an open position in which said bag handling assembly is accessible and allows for insertion of waste into said interior space and a closed position in which said bag handling assembly is inaccessible;

a base that supports said at least one wall; and a control mechanism coupled to said base and said lid and that controls opening and closing of said lid.

20. The container of claim 1, wherein said bag support is at least partly above said retainer and said closure component is at least partly above said bag support such that said bag support is between said retainer and said closure component when said bag support is pivoted against said retainer and said closure component is pivoted against said bag support.

* * * * *